US005410982A

United States Patent [19]

Mann

[11] Patent Number: 5,410,982

[45] Date of Patent: May 2, 1995

[54] ADJUSTABLE NET COVER FOR A RAFT

[76] Inventor: T. Sheridan Mann, 1432 Omega, Walled Lake, Mich. 48390

[21] Appl. No.: 197,935

[22] Filed: Feb. 17, 1994

[51] Int. Cl.[6] ..... B63B 17/00

[52] U.S. Cl. ..... 114/343; 114/270; 52/101

[58] Field of Search ..... 119/903; 410/96, 97; 114/343, 364, 270; 441/1, 35–40; 296/100; 52/101

[56] References Cited

U.S. PATENT DOCUMENTS

| | | | |
|---|---|---|---|
| 226,264 | 4/1880 | Beasley | 114/348 |
| 901,732 | 10/1908 | Olson | 114/346 |
| 1,037,111 | 8/1912 | Bethal | 441/1 |
| 3,128,478 | 4/1964 | Beal | 4/172 |
| 3,355,745 | 12/1967 | Jannuzzi | 4/172 |
| 3,656,749 | 4/1972 | Reyes | 441/1 |
| 4,100,706 | 7/1978 | White | 52/101 |
| 4,143,437 | 3/1979 | Voykin | 441/1 |
| 4,748,778 | 6/1988 | Rafter, Sr. | 52/101 |
| 4,847,925 | 7/1989 | Perry | 4/499 |
| 4,854,257 | 8/1989 | Grayson | 114/315 |
| 4,900,204 | 2/1990 | Summers | 410/97 |
| 5,013,270 | 5/1991 | Walls | 441/45 |

*Primary Examiner*—Edwin L. Swinehart
*Attorney, Agent, or Firm*—James M. Deimen

[57] ABSTRACT

An open net cover extendable over the deck of a swimming and diving raft to discourage and prevent waterfowl from alighting on the raft and befouling the deck. The net is temporarily attachable about the periphery of the raft and has an open multi-polygonal pattern that permits a swimmer to walk about the raft and thereby easily install or release the net. No attachment fittings on the raft are required. The net is constructed of elastic and non-elastic lines with slip knots at selected locations about the periphery of the net. The slip knots permit the distance of the net from the raft periphery to be adjusted as well as the attachment of the net at the corners of the raft. A central support raises the net cover above the deck of the raft an amount sufficient to discourage waterfowl from roosting. The central support also serves as a container for the storage of the net cover when not in use. The net cover is attached to the container in a manner that allows the net cover to be easily drawn into the container.

13 Claims, 1 Drawing Sheet

ADJUSTABLE NET COVER FOR A RAFT

BACKGROUND OF THE INVENTION

The field of the invention pertains to diving docks and rafts typically anchored in inland lakes and streams for sunbathing, swimming, diving and other water activities.

Unfortunately pigeons, seagulls, ducks, geese and herons find rafts pleasant resting places. As a result the bird droppings are not only unsightly and unpleasant to see and smell, but can be a health hazard and must be removed before the raft can again be enjoyed.

A wide variety of devices have been employed to humanely discourage birds from perching on rafts. Fake carvings of owls, hawks and other natural enemies have been mounted on rafts. Noise makers activated by wave motions have also been employed. However, the birds soon learn to ignore these distractions.

U.S. Pat. No. 4,748,778 discloses a wire guard assembly for piling tops to prevent seagulls, pelicans and other birds from perching thereon. U.S. Pat. No. 4,100,706 discloses a covering grid spaced above the ground to adversely condition waterfowl from roosting adjacent airports. The grid is generally rectangular and so spaced to interfere with the alighting of birds either on the ground below or on the grid itself.

A buoyant net is disclosed in U.S. Pat. No. 3,128,478 as a safety cover for swimming pools. Nets are also disclosed as cargo or person supporting components of rafts in U.S. Pat. Nos. 226,264; 901,732 and 5,013,270. Also related to the invention described below are the central supports in the form of large balls used to support pool or hot tub covers as disclosed in U.S. Pat. Nos. 3,355,745 and 4,847.925.

SUMMARY OF THE INVENTION

The invention comprises an open net cover extendable over the deck of a swimming and diving raft and temporarily attachable about the periphery of the raft. The net has an open pattern that permits a swimmer to walk about the raft and thereby easily install or release the net. No attachment fittings on the raft are required.

The net is constructed of elastic and inelastic lines in a multi-polygonal pattern with slip knots at selected locations about the periphery of the net. The slip knots permit the distance of the net from the raft periphery to be adjusted as well as the attachment of the net at the corners of the raft.

The raft net cover includes a central support that raises the net cover above the deck of the raft an amount sufficient to discourage waterfowl from roosting. In the preferred embodiment the central support comprises a container for storage of the net cover when not in use. The net cover is attached to the container in a manner that permits the net to be drawn down into the container. A lanyard may be attached to the net or container and the raft thereby preventing the net cover from drifting away from the raft when the net is stored in the container.

DESCRIPTION OF THE PREFERRED EMBODIMENTS

Figure 1:
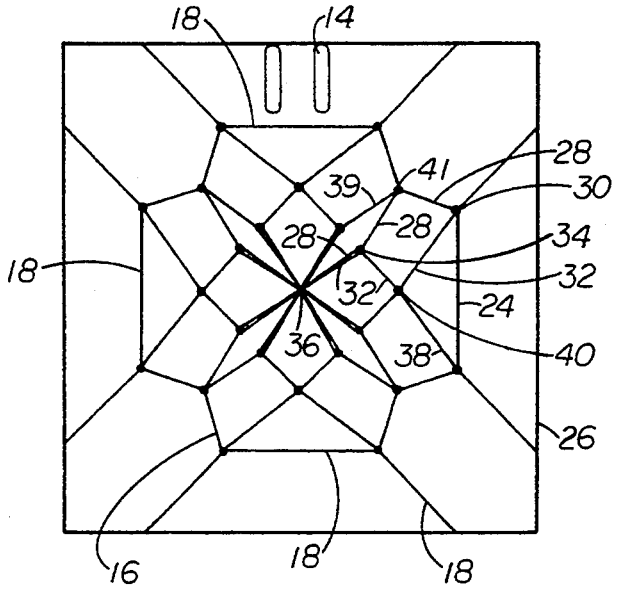
FIG. 1 is a plan view of the raft net cover as installed.
Figure 2:
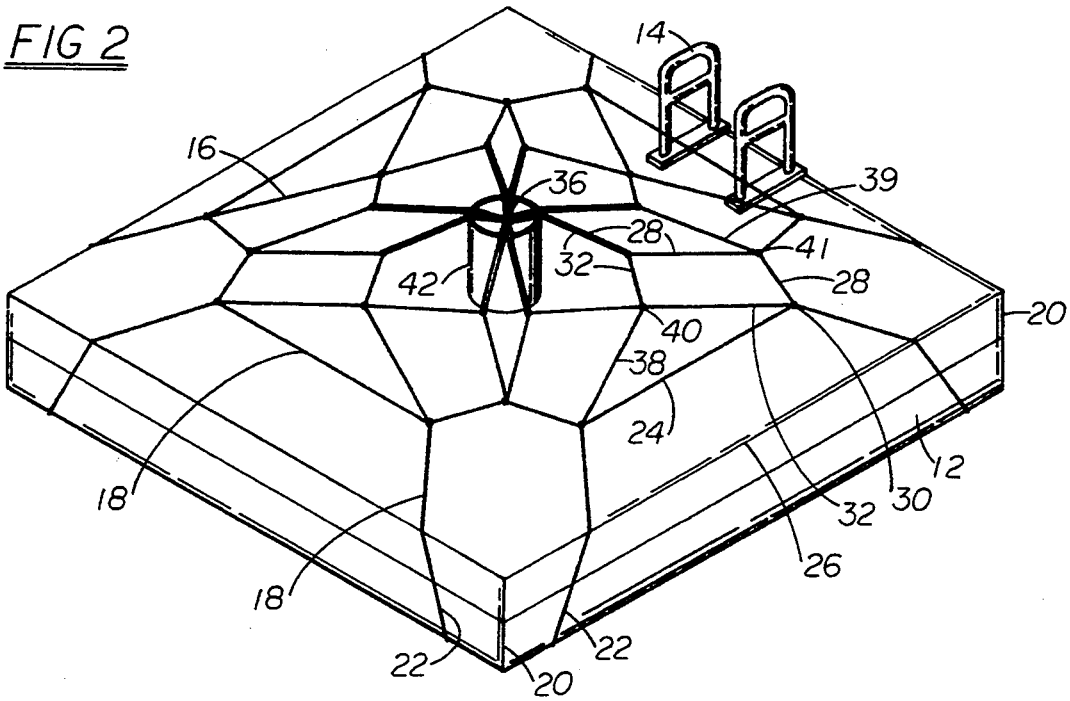
FIG. 2 is a perspective view of the raft net cover as installed.

In FIGS. 1 and 2 a typical diving platform or raft generally denoted by 10 is shown. The raft 10 may be supported by barrels, pontoons or rigid plastic foam 12 so as to float. Or, the raft 10 may be fastened to upright supports (not shown) resting on the bottom land beneath the water. The raft 10 may also be equipped with hand rails 14 to assist in climbing onto the raft from the water.

The net 16 in its preferred form as shown comprises an elastic peripheral line 18 that both extends under the raft corners 20 as at 22 and extends generally parallel as at 24 to the raft sides 26. Thus, line 18 forms the periphery of the net 16 and as installed loops under each corner of the raft 10.

Within the elastic line 18 is a multi-polygonal pattern of sixteen elastic lines formed into the pattern shown by the knots that join the lines together. For example, line 28 attaches to line 18 with a slip knot at 30. Likewise, line 32 attaches to line 18 with a slip knot at 30. The sixteen slip knots at the eight knot locations on line 18 permit the distance of the parallel portion 24 of line 18 from the raft sides 26 to be adjusted as well as the distance between the corner portions 22 of the line 18.

Line 32 attaches to line 28 with a fixed knot at 34 and both lines extend to the center 36 of the net 16. To continue the pattern line 38 attaches to line 32 with knot 40 and line 39 attaches to line 28 with knot 41. The center 36 of the net 16 is raised above the raft 10 by a hollow cylinder or container 42 thereby spacing the net above the raft 10 an amount sufficient to deter waterfowl and other birds from landing on the raft.

Figure 3:
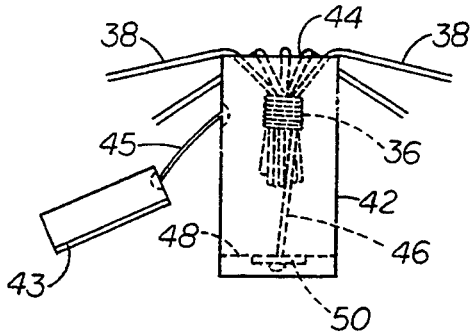
FIG. 3 is a detail of the central combined net support and net container.

As best shown in FIG. 3, the container 42 is open at the top 44 and the sixteen lines descend therein to the knot at 36. A short line 46 extends from the knot at 36 through the raised bottom 48 of the container 42 to a short bar or disc 50 to which the line 46 is attached. Thus, with the net 16 installed the container 42 acts as the central support and the disc 50 is tight against the underside of the raised bottom 48. When the elastic line 18 is detached from under the raft corners 20, the center of the net 16 may be quickly pulled into the container 42 using the disc 50 and then the entire net folded into the container 42. A container lid 43 may be attached to the container 42 by a cord 45 to prevent loss when the net is in use.

The size of the openings between the net lines permit a person to step therethrough and the distance of line 18 from the raft edge 26 permits a person to easily walk about the raft to install or release the net 16 at the raft corners 20. Thus, the net 16 can be easily released and stuffed into the container 42 by a swimmer who boards by the rails 14 and then reattached by the swimmer when the swimmer has finished using the raft.

The various lines may be one-quarter inches or less in diameter and no fittings are required to attach the net 16 to the raft 10. Thus, there are no hazards created by permanent attachments to the raft. With the net 16 stowed in the container 42 the short line 46 extends from the bottom 48 and serves as a lanyard that may be lashed to the rail 14 thereby preventing the container 42 and net therein from blowing or drifting away when the raft is in use by swimmers.

The unusual pattern of the net 16 is important in combination with the slip knots to adjust for the size of the raft and to adjust the distance of the net from the raft edge depending on the size of the waterfowl to be discouraged. Although shown for a square raft 10 in the figures, the net cover is applicable to rectangular and other polygonal shaped rafts. For a round or oval raft without corners small hooks or other fittings may be required. Such fittings should be attached under the raft adjacent the periphery to avoid endangering swimmers and divers who tend to frolic with abandon on and about a diving dock or raft. One of the major benefits of the new net cover is the avoidance of fittings on the sides or deck of the raft. The container 42 may be molded of a semi-rigid plastic typical of modern waste baskets, milk bottles and other common items.

I claim:

1. An open net raft cover to discourage aquatic birds from roosting on the raft comprising, an open net having a plurality of lines extendable over the deck of the raft, a plurality of elastic loops extending from the net at spaced locations about the periphery of the net and adapted to temporarily attach about the periphery of the raft, and means attached to the net to elevate at least a portion of the net above the deck.

2. The open net raft cover of claim 1 wherein the lines of the net adjacent the net periphery and the loops are sufficiently spaced apart to permit a person to step therebetween onto the deck.

3. The open net raft cover of claim 1 wherein the net lines form a pattern of triangles and quadrilaterals extending over the deck.

4. The open net raft cover of claim 1 wherein the elastic loops are attached to the net with slidable knots.

5. The open net raft cover of claim 1 wherein the means to elevate the net include storage means therein to stow the net.

6. The open net raft cover of claim 1 wherein the plurality of elastic loops extending from the net comprises a single elastic line attached by slidable knots about the periphery of the net.

7. A raft cover to discourage aquatic birds from roosting on the raft comprising, an open net extendable over the deck of the raft, a plurality of elastic loops extending from the net at spaced locations about the periphery of the net and adapted to temporarily attach to the raft, said elastic loops attached to the net with slidable knots to adjust the length of the loops and with the lines of the net adjacent the net periphery and the loops sufficiently spaced apart to permit a person to step therebetween onto the deck, a support attached to the center of the net, the support including storage means therein to stow the net.

8. The raft cover of claim 7 wherein the net comprises a pattern of triangles and quadrilaterals extending over the deck.

9. The raft cover of claim 7 wherein the plurality of elastic loops extending from the net comprises a single elastic line attached by the slideable knots about the periphery of the net.

10. A raft cover to discourage aquatic birds from roosting on the raft comprising, an open net formed from a plurality of lines including an outermost line and inner lines knotted together to form a pattern of concentric rows of triangles and quadrilaterals about a center, the inner lines being non-slidably knotted together, the outermost line being an elastic line attached with slidable knots to the next adjacent lines of the net, and the elastic line being attachable to the raft.

11. The raft cover of claim 10 including a support attached to the center of the net, the support including storage means therein to stow the net.

12. The raft cover of claim 10 wherein the elastic line forms loops attachable to the raft, the loops extending between a pair of slideable knots and the loops spaced apart by straight portions of elastic line between pairs of knots.

13. The raft cover of claim 10 wherein each of the inner lines extend from the outermost line to a central knot.

* * * * *